United States Patent [19]

Libby

[11] Patent Number: 5,045,378

[45] Date of Patent: Sep. 3, 1991

[54] PAPERBOARD SHEETS WITH A SCRIBED GRID AND A METHOD FOR MAKING THE SAME

[75] Inventor: Edward L. Libby, Big Canoe, Ga.

[73] Assignee: Specialty Paperboard Inc., Keene, N.H.

[21] Appl. No.: 346,453

[22] Filed: May 2, 1989

Related U.S. Application Data

[63] Continuation-in-part of Ser. No. 195,819, May 19, 1988, abandoned.

[51] Int. Cl.[5] ..... B32B 3/00; B32B 31/00; D21H 11/00

[52] U.S. Cl. ..... 428/153; 428/155; 428/156; 428/167; 428/219; 428/340; 428/537.5; 40/616; 156/250; 156/254; 156/271; 162/109; 162/120; 162/194; 162/197

[58] Field of Search ..... 428/167, 136, 152, 153, 428/154, 155, 537.5, 167, 219, 136, 137, 156, 170, 172, 220, 340, 409; 162/111, 113, 114, 120, 197, 194, 109, 202, 220; 156/250, 252, 253, 254, 257, 271; 40/154, 124.1, 624, 616

[56] References Cited

U.S. PATENT DOCUMENTS

| | | | |
|---|---|---|---|
| 2,668,786 | 2/1954 | Perry | 428/170 |
| 2,778,658 | 1/1957 | Kaighin | 428/155 |
| 3,130,412 | 4/1964 | Fox et al. | 428/537.5 |
| 3,214,855 | 11/1965 | Winkler et al. | 40/154 |
| 4,407,417 | 10/1983 | Boyle | 211/69.9 |
| 4,751,115 | 6/1988 | Smith et al. | 428/187 |
| 4,854,610 | 8/1989 | Kwiatek | 156/234 |

*Primary Examiner*—Ellis P. Robinson
*Assistant Examiner*—Donald J. Loney
*Attorney, Agent, or Firm*—Laubscher, Presta & Laubscher

[57] ABSTRACT

A scribed paperboard sheet and a method for its manufacture is characterized by scribing a plurality of parallel guidelines in a finished paperboard web while the web is being tensioned. Adjustable scribing knife assemblies are provided for simultaneously scribing both surfaces of the web, following which the web of scribed paperboard is cut into individual sheets. The depth of penetration and the lateral spacing of the scribing knives are controlled to define a particular scribed layout of lines in the surfaces of the paperboard sheets. Alternatively, a grid of guidelines may be scribed into the web by an embossed roller arranged adjacent a tension roller to define a nip through which the paperboard web passes.

6 Claims, 2 Drawing Sheets

PAPERBOARD SHEETS WITH A SCRIBED GRID AND A METHOD FOR MAKING THE SAME

This application is a continuation-in-part of U.S. application Ser. No. 195,819 filed May 19, 1988, now abandoned.

BACKGROUND OF THE INVENTION

The present invention relates to an improved method for scribing finished paperboard and to the scribed paperboard product which is utilized for signs, posters, and other display purposes.

A large volume of paperboard products is used by schools, churches, small businesses, and individuals to make signs, posters, and displays. In general, these displays are prepared by hand as opposed to by a printing process. In order to produce a professional looking product, the user must lay out, measure, and mark guidelines on the sheet of paperboard. This is an inconvenient, time consuming, and often inaccurate process. In addition, the guidelines marked on the paperboard sheet must often be removed when the display is finished so as not to impair the finished appearance.

Paperboard is manufactured on paper machines in roll form. From the roll, a web of paperboard is delivered to a shearing device where the web is cut into sheets. The shearing device may comprise an integral component of the paper machine or a separate processing station. The present invention incorporates a web scribing operation in connection with the shearing of the paperboard web into sheets, whereby uniform guidelines are formed in the paper as the web is cut into sheets.

BRIEF DESCRIPTION OF THE PRIOR ART

Various paperboard deforming devices are well-known in the patented prior art as evidenced by the U.S. patents to Perry U.S. Pat. No. 2,668,786, Jenks U.S. Pat. No. 701,734, Blake U.S. Pat. No. 4,239,591, and Robbins et al U.S. Pat. No. 4,181,070. The Perry patent, for example, discloses a corrugated packing sheet in which rolls are introduced which serve to impress into the corrugations a series of parallel score lines. Similarly, the Jenks patent discloses a paper processing device wherein a pulpy mass of paper material passes under a pair of rolls to form channels in the paper. The Blake patent discloses the manufacture of a paper web having regions of increased thickness. Wood pulp is fed under a slice which varies in vertical thickness at spaced locations along the web so that bands of increased thickness are formed therein. Finally, the Robbins et al patent teaches a method of manufacturing variable pleat paper wherein a roll of resin-impregnated paper is fed between a pair of scoring elements following which the scored paper is pleated or folded and then cured.

While the prior devices normally operate satisfactorily, they are designed to deform paper or paperboard before it is cured or hardened rather than processing a finished paper web in conjunction with shearing the web into individual sheets. Moreover, the prior methods and apparatus do not afford easy and adequate control of the depth of the deformation formed in the paper nor the lateral spacing between deformations. This is particularly true of the prior devices where the paper being rolled or the like is in a pulpy or pliable condition which tends to spring back to its natural configuration following rolling.

The present invention was developed in order to overcome these and other drawbacks of the prior devices by providing a rotary scoring or creasing method for a finished paperboard web which may be controlled to form any desired parallel arrangement of guidelines in the web in conjunction with cutting the web into a plurality of sheets.

SUMMARY OF THE INVENTION

Accordingly, it is a primary object of the present invention to provide a method for scribing lines in paperboard sheets from a roll of paperboard material. A web of paperboard is delivered from the roll by first drive rollers. Tensioning rollers arranged downstream of the first drive rollers tension the web. A plurality of laterally spaced scribing knives are arranged adjacent the tension rollers for forming a plurality of parallel creases in at least one surface of the web. Second drive rollers are arranged at the output of the tension rollers for delivering the scribed web to a receptacle, and shearing knives at the output of the second drive rollers cut the scribed web into sheets of paper of a given length prior to delivery to the receptacle.

It is a more specific object of the invention to simultaneously scribe the top and bottom surfaces of the web.

According to a further object of the invention, the positioning of the scribing knives relative to the web is independently adjustable for each knife to vary the depth of penetration of the knives into the web surfaces. Thus by accurately setting the penetration depth, the web may be creased, scored, or cut as desired.

According to yet another object of the invention, the lateral spacing between the scribing knives is adjustable, whereby scribed guidelines of a particular depth and spacing may be formed in the web to accurately define a desired scribed layout.

According to a further object of the invention, an embossing roller is substituted for the scribing knives to emboss a given pattern in at least one surface of the web. For example, the embossed roller may have a grid pattern on the outer surface thereof which produces a grid of creases in the web. The roller may be replaced with a roller having embossed surfaces of different configurations to produce different patterns on the web surface.

BRIEF DESCRIPTION OF THE FIGURES

Other objects and advantages of the subject invention will become apparent from a study of the following drawing, in which.

DETAILED DESCRIPTION

As is known in the art, paperboard is manufactured from a paper machine and stored in large rolls. The method according to the invention relates to the scribing of a web of paper from such a roll of paperboard as the paperboard is being cut into individual sheets. The invention also relates to an improved paperboard product for producing display and poster board with scribed guidelines or grids for positioning manual lettering, art work, or other materials for display.

Figure 1:
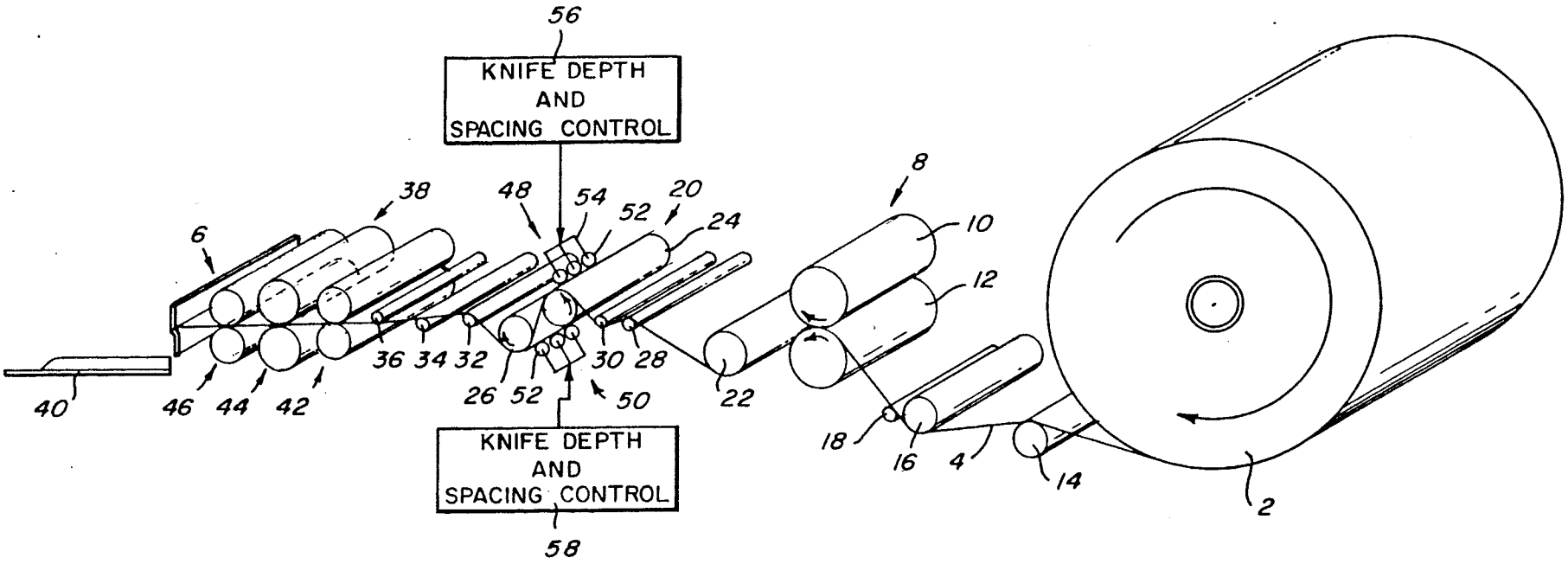
FIG. 1 is a perspective view of the scribing apparatus according to a first embodiment of the invention.

Referring to FIG. 1 of the drawing, a roll of paperboard 2 supplies a web of paper 4 to a shearing assembly 6 where the web of paper is cut into a plurality of sheets having uniform dimensions. More particularly, a first drive roller assembly 8 draws the web of paper from the paperboard roll. The first drive roller assembly comprises an upper roller 10 and a lower roller 12 which are vertically aligned, parallel, and driven in opposite directions with the web being arranged in contiguous relation therebetween. The paper web passes over an idle guide roller 14 and between idle guide rollers 16, 18 prior to passing between the first drive rollers 10, 12. The rollers of the first drive assembly preferably have a friction surface for gripping the web of paper to transmit the web uniformly without wrinkling.

From the first drive roller assembly 8, the web is delivered to a tension roller assembly 20 to tension the web. Between the first drive roller assembly 8 and the tension roller assembly 20, the web passes under an idle guide roller 22. The tension roller assembly includes main tension rollers 24, 26 which rotate in opposite directions and which are vertically offset or misaligned as shown in the drawing, with their axes parallel. The tension roller assembly also includes spaced parallel auxiliary guide rollers 28, 30, 32, 34, and 36 which assist in feeding and removing the web relative to the main tension rollers.

Between the output of the tension roller assembly 20 and the shearing assembly 6 is a second drive roller assembly 38 which delivers the paperboard web to the shearing assembly for cutting the web into sheets which are deposited in a receptacle 40. The second drive roller assembly comprises one or more pairs of vertically aligned parallel rollers driven for rotation in opposite directions with the web arranged between the rollers of each pair. In the example shown in the drawing, three pairs of rollers 42, 44, 46 are shown comprising the second drive roller assembly 38.

Adjacent the upper tension roller 24 is an upper scribing assembly 48 and adjacent the lower tension roller 26 is a lower scribing assembly 50, with the web passing between the associated rollers and scribing assemblies, respectively.

Each scribing assembly includes a plurality of laterally spaced parallel scribing knives 52. Each scribing knife preferably comprises a roller rotatably connected with a frame 54, each roller having an edge adapted to engage and crease or deform the surface of the web. A knife depth and spacing control device 56 is connected with the upper scribing assembly and a similar control device 58 is connected with the lower scribing assembly. By operating the controls, the depth of penetration of each roller into the adjacent surface of the web is controlled. For example, if it is desired to merely crease the top surface of the web, the control 56 is operated to provide minimal penetration of the web by the upper scribing rollers. If it is desired to score the upper surface, the depth of penetration of the rollers may be increased. With rollers having a sharp scribing surface, the web may be severed completely by setting the depth of penetration to its maximum. Scribing lines or marks of different depths may also be provided across the lateral upper surface of the web since each scribing roller may be set independently of the others as regards the depth of penetration. Similar control of the scribing depth of the lower scribing assembly is afforded by the lower control device 58. Owing to the adjustability of the scoring knives toward or away from the web surfaces, it will be apparent to those skilled in the art that webs of varying thickness may be accurately scribed by the present invention.

The control devices 56 and 58 also operate to control the lateral spacing of the scribing tools independently across the face of the web. Accordingly, the distance between the marks, lines, or creases formed by the scribing tools may be set or varied in accordance with a desired finished layout.

In order to readily accept and retain the scribed lines or creases, the paperboard from the supply roll 2 has a density on the order of 0.8 g/cc and a moisture content of between 6 ½ and 7 ½ by weight.

In operation, the control devices 56, 58 are operated to set the desired depth of penetration of the upper and lower scribing rollers, respectively, as well as the desired spacing between the rollers of each assembly. The paper web 4 is then delivered from the supply roll 2 to the tensioning assembly 8 by the first drive roller assembly. At the tensioning assembly, the web is tensioned and simultaneously scribed with the desired layout on both the top and bottom surfaces thereof by the upper and lower scribing assemblies 54. The scribed and tensioned web is then delivered to the shearing assembly 6 by the second drive roller assembly 38 where the web is cut into sheets of the proper dimension which are deposited into the receptable 40.

Thus in a single operation, a paperboard web is economically and efficiently scribed and cut into sheets of poster or display paperboard having a desired layout of markings for use in creating a sign or display.

Figure 2:
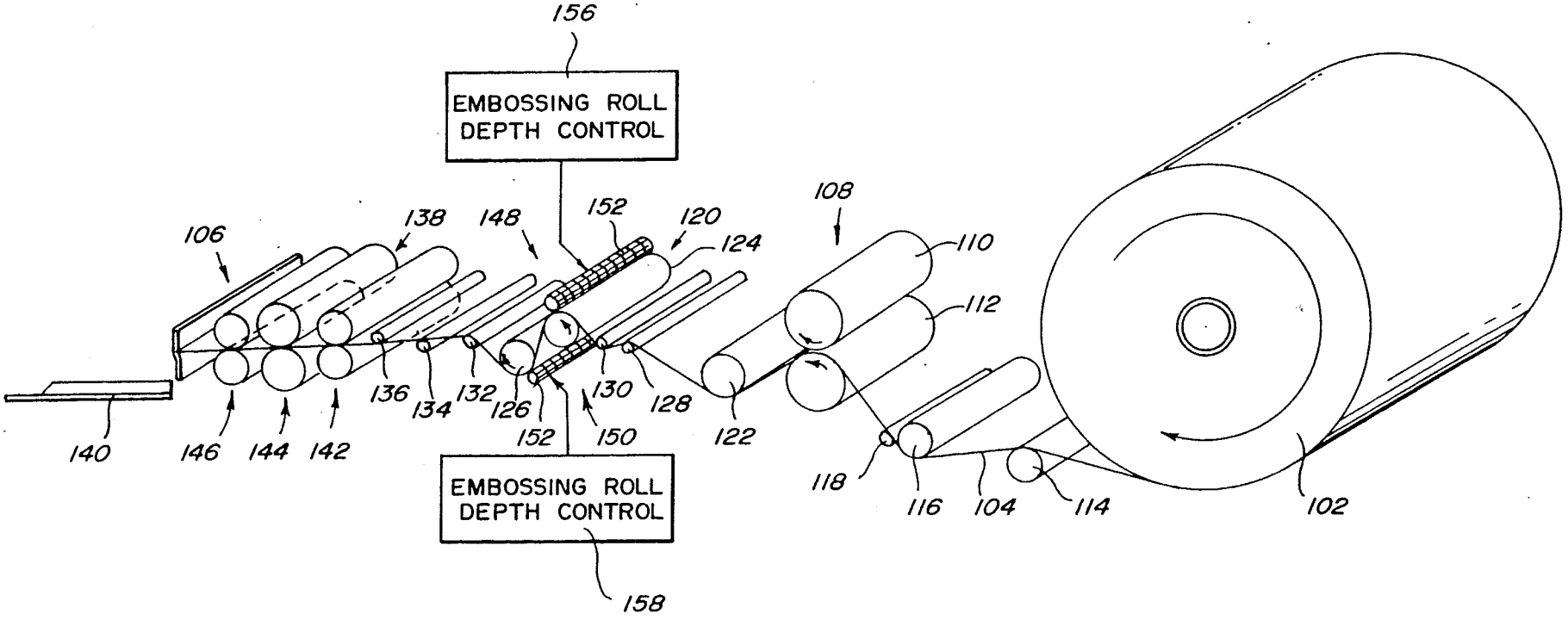
FIG. 2 is a perspective view of the scribing apparatus according to a second embodiment of the invention.

The embodiment shown in FIG. 2 is similar to that of FIG. 1 in that a roll of paperboard 102 supplies a web 104 of paperboard having a density on the order of 0.8 g/cc and a moisture content of between 6.5% and 7.5% by weight to a shearing assembly 106 via a first drive roller assembly 108 including an upper roller 110 and a lower roller 112. The apparatus includes idle guide rollers 114, 116, 118, 122 and a tension roller assembly 120 including main tension rollers 124, 126 and auxiliary guide rollers 128, 130, 132, 134, and 136. A second drive roller assembly 138 delivers the web to the shearing assembly 106 following which cut sheets are deposited in a receptacle 140. As in the first embodiment, the second drive roller assembly 138 comprises three pairs of rollers 142, 144, 146.

The difference in the embodiment of FIG. 2 from that of FIG. 1 lies in the upper and lower scribing assemblies 148, 150. More particularly, engraved embossing rollers 152 are provided adjacent the upper 124 and lower 126 rollers, respectively, of the tension roller assembly 120 to define a nip through which the web passes.

With the web passing through the tension assembly 120, the embossing rollers form into the respective surfaces of the tensioned web an embossed pattern corresponding with that engraved on the roller surface. For example, the rollers 152 may be provided with a grid of protruding intersecting lines which are pressed into the tensioned web to replicate a grid of creased lines in the surfaces thereof. The lines may be arranged in rows and columns to define the grid.

While in the drawing there are shown two embossing rollers for simultaneously creasing both surfaces of the web, it is readily apparent that only one embossing roller need be arranged in the operative position if only one web surface is to be treated. Thus there are provided upper and lower embossing roll depth control devices 156, 158, respectively, which can be operated to displace the frame (not shown) with which each roller is rotatably connected toward or away from the associated tension rollers 124, 126 between operative and idle positions, respectively.

The depth control devices also control the depth of the creases formed in the web surface through relative positioning of the rollers 152 with respect to the tension rollers. If it is desired to score the upper surface, the depth of penetration of the rollers may be increased. With rollers having a sharp embossing surface, the web may be severed completely by setting the depth of penetration to its maximum. Owing to the adjustability of the embossing rollers toward or away from the web surfaces, it will be apparent to those skilled in the art that webs of varying thickness may be accurately scribed by the present invention.

In the event that a different layout or a grid having different spacing between the grid lines is desired, it is a simple matter to substitute a different embossing roller having the desired layout engraved on the surface thereof.

The paper product produced using the method and apparatus of both embodiments is particularly suitable for use as a posterboard on which information is to be written. At a close distance, the scribed lines or creased grid are readily visible and thus provide a guide or rule to assist the user (such as a teacher or student) in accurately printing a message or artwork thereon. However, by taking a few steps away from the posterboard, the lines become invisible owing to their narrow width. The finished product thus has a much improved appearance over prior paperboard products having guide lines printed thereon.

Because the lines are formed into the surface of the finished paperboard product while the product is under tension (using the apparatus and method of either Figure), the lines are permanently retained within the paperboard surface, yet are extremely narrow and thus less visible to the eye when viewed at a distance. This is because when the finished paperboard web leaves the tension assembly, the web compresses slightly back to its untensioned state. This compression essentially shrinks the thickness of the creases formed in the surfaces of the web.

While in accordance with the provisions of the patent statue the preferred forms and embodiments of the invention have been illustrated and described, it will be apparent to those of ordinary skill in the art that various changes and modifications may be made without deviating from the inventive concepts set forth above.

What is claimed is:

1. A paperboard sheet used for signs and posters, comprising a layer of finished paperboard material having smooth surfaces, a density of 0.8 g/cc and a moisture content of between 6.5 and 7.5% weight, at least one of said layer surfaces containing a plurality of scribed lines extending continuously thereacross between the edges thereof, said lines being formed by delivering a web of finished paperboard from a roll, tensioning the web, scribing the web surface simultaneously with tensioning of the web and shearing the scribed web into individual generally planar sheets.

2. A paperboard sheet as defined in claim 1, wherein said scribed lines are arranged in a spaced, parallel configuration.

3. A paperboard sheet as defined in claim 1, wherein said scribed lines comprise intersecting rows and columns of parallel lines to define a grid.

4. A paperboard sheet as defined in claim 1, wherein said scribed lines comprise creases.

5. A paperboard sheet as defined in claim 1, wherein said scribed lines comprise scorelines.

6. A paperboard sheet as defined in claim 1, wherein said scribed lines are formed in both surfaces of said web.

* * * * *